United States Patent [19]

Kurtz

[11] Patent Number: 5,058,769

[45] Date of Patent: Oct. 22, 1991

[54] SELF-CONTAINED PNEUMATIC GUN FOR DISPENSING FLOWABLE MATERIALS

[75] Inventor: Robert H. Kurtz, Canton, Ohio

[73] Assignee: Liquid Control Corporation, North Canton, Ohio

[21] Appl. No.: 487,848

[22] Filed: Mar. 5, 1990

[51] Int. Cl.[5] ..... B67D 5/42

[52] U.S. Cl. ..... 222/47; 222/334; 222/389; 137/102; 91/422

[58] Field of Search ..... 222/47, 49, 50, 137, 222/334, 325-327, 389; 91/40, 422, 442; 137/102

[56] References Cited

U.S. PATENT DOCUMENTS

| | | | |
|---|---|---|---|
| 3,138,303 | 6/1964 | Hoveland | 222/389 |
| 3,254,806 | 6/1966 | Madsen | 222/389 X |
| 3,910,466 | 10/1975 | Collar | 222/334 X |
| 4,253,692 | 3/1981 | Garlinghouse | 91/442 X |
| 4,570,832 | 2/1986 | Kroger | 222/389 X |
| 4,676,410 | 6/1987 | vonFlue | 222/389 X |
| 4,834,268 | 5/1989 | Keller | 222/327 |
| 4,846,373 | 7/1989 | Penn et al. | 222/327 X |
| 4,871,088 | 10/1989 | Cox | 222/334 X |
| 4,878,513 | 11/1989 | Ashby et al. | 137/102 |
| 4,911,328 | 3/1990 | Keller | 222/389 X |

FOREIGN PATENT DOCUMENTS

| | | | |
|---|---|---|---|
| 3518780 | 11/1986 | Fed. Rep. of Germany | 222/389 |

OTHER PUBLICATIONS

Advertisement—Precision Liquid Meter, Mix and Dispense Systems, Liquid Control Corporation.

Advertising literature—Twinmixer Data Sheet No. DV100, Liquid Control Corporation.

Advertising literature—Posimixer 60/40 Bulletin No. PM 100, Liquid Control Corporation.

Advertising literature—Posimixer 60/40 Bulletin No. PM 101, Liquid Control Corporation.

Advertising literature—Frontrunner FRH-600 data sheet DV 101, Liquid Control Corp.

Advertising literature—The Front Runner Model No. FRH 300-P, Liquid Control Corp.

Advertising literature—Product Update Bulletin No. 103, Liquid Control Corp.

Advertising literature—Supermix Dispensing System, Liquid Control Corp.

Advertising literature—Supermix II Dispensing System, Liquid Control Corp.

*Primary Examiner*—Michael S. Huppert

*Assistant Examiner*—Gregory L. Huson

*Attorney, Agent, or Firm*—Michael Sand Co.

[57] ABSTRACT

A self-contained self-muffled pneumatic gun for dispensing one or two combinable flowable materials from a prefilled package or cartridge. The gun has a first hollow chamber for retaining the package in fixed relation, the package containing the materials to be dispensed and either having a dispensing valve thereon or not as known in the art. A second hollow chamber of the gun retains an axially-movable hollow tubular piston for pneumatically forcing discharge from the gun and through a metering, mixing and/or dispensing nozzle. The hollow piston has a quick-release valve mounted internally in its head portion for rapid release of pressurized gas internally of the gun body for its relatively quiet operation. Internal release of the gas pressure within the head portion serves to prevent noisy operation of the gun. The gun is capable of economical manufacture with the valve components being formed from essentially non-machined moldable components.

17 Claims, 4 Drawing Sheets

SELF-CONTAINED PNEUMATIC GUN FOR DISPENSING FLOWABLE MATERIALS

BACKGROUND OF THE INVENTION

1. Technical Field

The present invention relates to dispensing apparatus and in particular to a portable self-contained pneumatic gun for dispensing metered and/or mixed single or plural-component flowable materials. More particularly, the invention relates to a portable dispensing pneumatic gun which is self-contained and internally muffled for delivering flowable materials from single or two-component packages wherein the flowable materials are metered and/or mixed closely adjacent to the point of dispensing or application.

2. Background Information

An ever increasing number of products used in everyday life require the dispensing of liquid or semi-liquid flowable materials in one form or another for their manufacture. These flowable materials typically comprise two-component reactive resins: however, single component flowable materials are also frequently employed in such manufacture. The types of materials dispensed include virtually any flowable liquid, semi-liquid, or paste such as epoxies, polyurethanes, silicones, polyesters, acrylics, polysulfides and phenolics, for example. Common commercial manufacturing processes in which such materials are used include injecting precise amounts of mixed resins into molds, encapsulating electric components with insulating resins, applying continuous beads of structural adhesives, injecting polyesters into closed molds, sealing joints with two-part polysulfides, and numerous other functions requiring accurate material control and delivery. Examples of product applications for these materials and processes include under-the-hood electronic assemblies and safety devices for the automotive and trucking industry; encapsulation of magnetic and other advanced electrical devices for the aerospace industry; component mounting, security potting and gun-type applications for circuit board assemblies and components and apparatus such as switches, power supplies, heating assemblies, and other electronic components for the appliance industry.

Thus, as the aforesaid flowable materials continue to be consumed in increasing quantities the demand for precise liquid and semi-liquid dispensing apparatus is also growing at an accelerated rate. The industry is continually searching for more reliable, efficient and accurate metering and/or mixing and dispensing apparatus for flowable materials for a variety of purposes. For example, a particular application may require that an apparatus efficiently and accurately dispense such materials ranging in amounts from less than 1 cubic centimeter to many gallons. However, although, the industry is calling for more exacting apparatus, it is also requiring that the apparatus design be simple, straightforward and capable of being operated by production personnel or conveniently integrated with automation devices such as robots and conveyor systems. Problems currently exist because many prior art metering, mixing and dispensing apparatus are immobile, requiring that the work be brought to the apparatus which most often is inefficient and impractical.

Moreover, the design of many types of the prior art metering, mixing and dispensing apparatus, due to their bulky nature and the inability to position the apparatus in close proximity to the work, include lengthy hoses for transport of the metered and/or mixed material, the components of which often begin to react prematurely, sometime before it is actually dispensed which is highly undesirable. Rather, it is preferable that the flowable materials be metered and/or mixed as closely as possible to the point of dispensation or application to avoid premature reaction of the materials. Also, locating the metering and mixing components of the apparatus as closely as possible to the dispensing point increases metering accuracy and control.

A most common problem with known dispensing guns is the matter of overrun discharge or dribbling of the flowable materials when dispensation is stopped or terminated. The slow release of pressure on the piston member causes the materials to continue to flow at a decreased rate until pressure is fully relieved resulting in inaccurate dispensing and improper ratios of mixed materials. Where two-component materials are dispensed simultaneously, they may have different flow and viscosity characteristics accentuating the inaccuracy of desired delivery. Loss of precise delivery of desired amounts is a frequent problem especially where small volumes are dispensed.

The structure of the subject apparatus is different from the prior art equipment. The subject improved dispensing gun of the pneumatic type of this invention is portable and self-contained. The need exists for an improved metering, mixing and/or dispensing apparatus in which single or plural-component flowable materials are metered and/or mixed adjacent to the point of dispensing and/or application, and which is portable enough to be handled by a human operator and/or which may be readily integrated with robotic or automation systems.

SUMMARY OF THE INVENTION

Accordingly, it is an objective of the present invention to provide a metering, mixing and dispensing pneumatic gun in which plural-component liquids, semi-liquids or pastes are delivered from prefilled packages or cartridges and released at a dispensing or applying location by readily portable simplified apparatus.

Another object of the invention is to provide a self-contained pneumatic gun which is portable and self-muffled for quiet operation and is easily handled by a human operator and which can be conveniently integrated into robotic and/or automation systems.

A further object of the invention is to provide a self-contained pneumatic gun for metering or mixing, and dispensing flowable materials in which the gun is internally muffled and provides for quick release of pressurized operating gas for positive control of material delivery.

Still another objective of the invention is to provide a self-contained dispensing gun of the pneumatic type which can dispense either unitary or a plurality of flowable materials having a wide range of viscosities and cure times from prefilled packages containing the flowable materials.

A still further objective of the invention is to provide a metering, mixing and dispensing gun which allows for accurate volume and delivery rate variability and which can accurately dispense flowable materials contained in single or multiple component packages or cartridges.

Another object of the invention is to provide a self-contained quietly operable pneumatic gun for flowable materials for dispensing such materials in properly metered and/or mixed relationship in which solvent purging of the mixer element is eliminated by the use of an integral disposable static mixer.

A still further objective of the invention is to provide a metering or mixing and dispensing gun of the pneumatic type which is operative by either relatively low-pressure or high-pressure compressed air or other gas and which is accurate in dispensing small volume output shots from prefilled packages. The gun is consistent and reliable for delivering the materials to both accessible and relatively inaccessible locations, the gun being portable, lightweight, compact and durable.

These objectives and advantages are obtained by the subject self-contained quietly-operable pneumatic gun for metering or mixing and dispensing at least two combined flowable materials from prefilled packages, the exact nature of the gun which may be stated as including at least one hollow chamber adapted to receive and retain the material-containing package and having a piston chamber for retaining an operating piston and its operative pressurized gas. The piston being hollow is located in an aligned second hollow chamber which is pressurized by a compressed gas delivered to the head of the hollow piston by a flexible internally-disposed tubular member connected to a quick-release valve mounted on the piston head for rapid discharge of the pressurized gas interiorly of the hollow piston and body member. The opposite end of the elongated piston is adapted to contact the cartridge for delivery of the material therefrom. The quick-release valve is mounted internally of the gun for discharge of the operative gas internally of the gun for its operation at minimal noise levels. The gun has a support handle mounted centrally between the package and piston chambers, the flexible tubular member for the introduction of pressurized gas being mounted spirally around the hollow piston for its collapse around the piston between the gun body member and the quick-release valve. The subject gun is fabricated from essentially non-machined moldable components for economical and simplified manufacture at very economical cost. The gun may be employed to dispense flowable materials from a wide variety of prefilled packages or cartridges which can have a great disparity in shape and cross-sectional contour. The packages may be cylindrical or rectangular in shape, or be comprised of side-by-side parallel attached chambers or other configurations known in the art. The packages may be formed of rigid, semi-rigid or flexible bag-like plastic materials. The package retention chamber of the gun can be modified as desired to accept and retain the package for dispensing therefrom without substantial change of the operative components of the gun. Such packages may be described as axial, co-axial, parallel or side-by-side.

BRIEF DESCRIPTION OF THE DRAWINGS

A preferred embodiment of the invention, illustrative of the best mode in which applicant has contemplated applying the principals and functions of the subject portable self-contained gun is set forth in the following description and is shown is the drawing and is particularly and distinctly pointed out and set forth in the appended claims.

Similar numerals refer to similar parts throughout the drawings.

DESCRIPTION OF THE PREFERRED EMBODIMENT

The pneumatic gun of the present invention is indicated generally at the numeral 10 and is shown in FIGS. 1 to 5 of the drawings. Gun 10 is primarily intended for delivering plural components from a prefilled two-component package or cartridge which is mounted within a package or cartridge chamber 11 located at the forward delivery end of the gun. The nature of the packages or cartridges is not intended to be a unique feature of the present invention since they have been previously described is the known prior art. Such packages or cartridges are employed in a wide range of manufacturing processes such as resin transfer molding, electrical potting and encapsulation structural bonding, sealing, casting and filling. However, if desired, gun 10 can be used for accurately metering or mixing and dispensing flowable single or plural types of materials from prefilled cartridges containing the constituents. It is primarily designed for dispensing paired types of flowable materials which are inter-reacted at the point of use and are especially useful in the manufacture of everyday commercial products such as components for use in the automotive and truck industry, as well as transformers, cable connectors, de-scrambler modules and components for the telecommunications industry.

Figure 1:
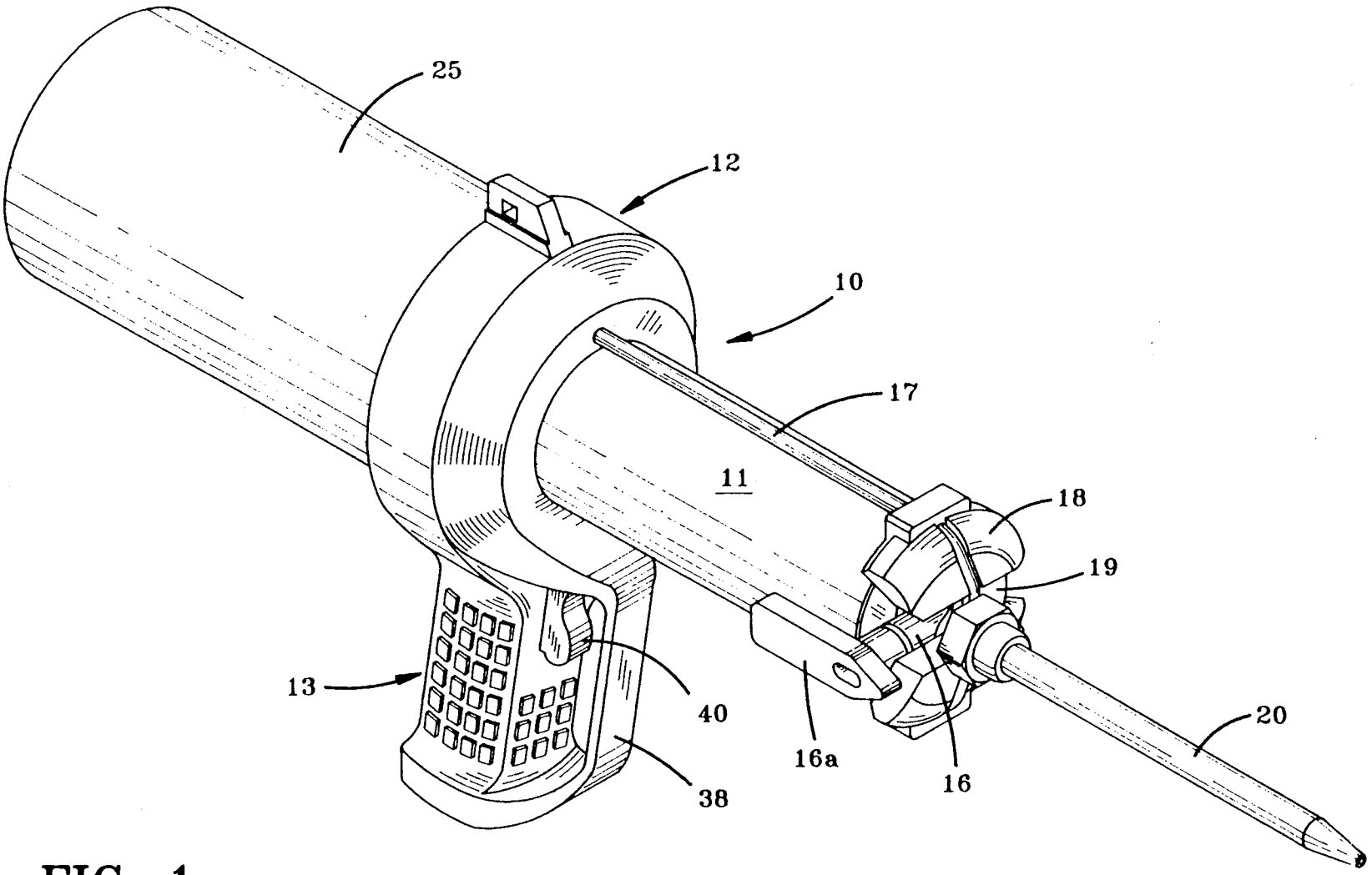
FIG. 1 is a perspective view of the self-contained, self-muffled portable pneumatic gun of the present invention.
Figure 2:
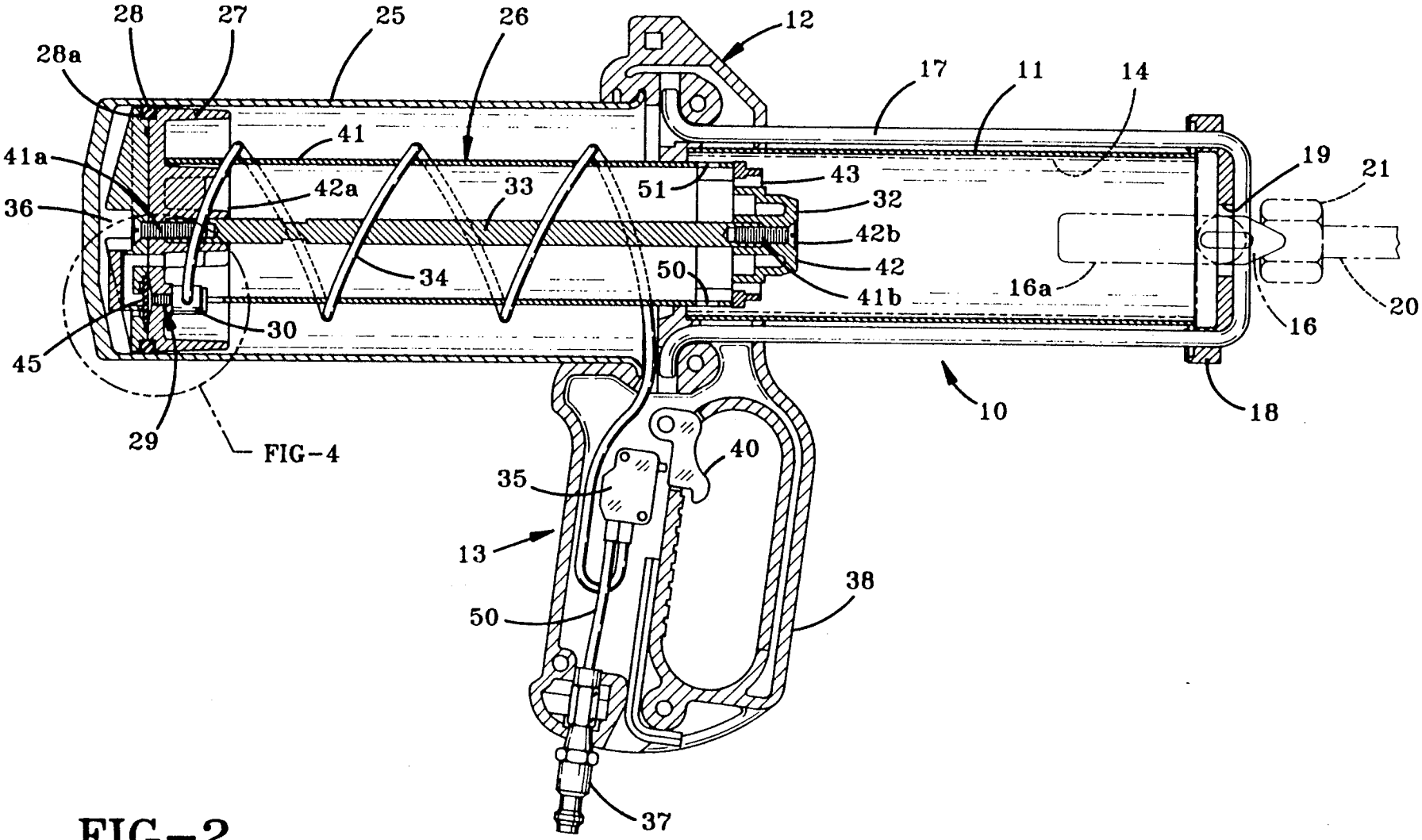
FIG. 2 is a longitudinal vertical sectional view of the pneumatic gun taken along a central axial region of the gun shown in FIG. 1.
Figure 3:
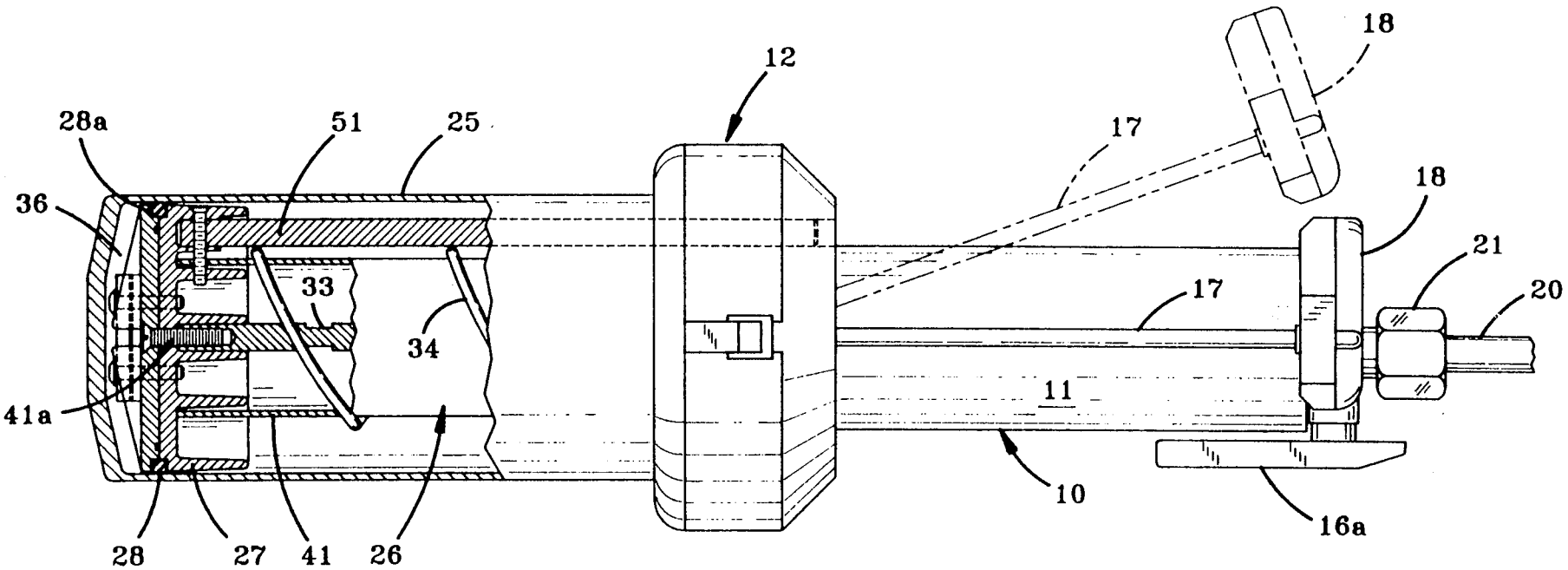
FIG. 3 is a top plan view partially in fragmentary horizontal section of the gun shown in FIGS. 1 and 2.

Gun 10 preferably includes a generally cylindrical body member indicated generally at numeral 12 as shown in FIGS. 1 to 3. Body member 12 is preferably right-cylindrical in shape and includes a projecting handle member 13 adapted to supporting and controlling the portable gun. Body 12 has a cylindrical cartridge chamber 11 retailed thereon projecting forwardly adapted to receive and retain a complementally-contoured cartridge 14 shown in dotted outline. Chamber 11 has an open forward end through which the cartridge may be axially inserted into the chamber 11 from its forward end. The cartridge may or may not have an on/off valve 16 as shown on FIGS. 1 and 2 on its delivery end for opening and closing the delivery end of the cartridge by a projecting handle 16*a*. Package or cartridge chamber 11 need not be right-cylindrical in shape, but may be oval, square or rectangular in cross-sectional shape to retain a complementally-shaped package of similar size and shape depending upon known and newly-developed packages for a wide variety of flowable materials. The retention chamber 11 may be changed or replaced as desired or required by its separation from the body 12 and replacement by a different size and shape. The terts package or cartridge are used interchangeably herein since both are so used by skilled artisans in the subject art.

The cartridge 14 is retained in place by a hinged bifurcated retention member 17 which is swingably connected to body member 12 and is employed to retain the delivery end of the cartridge in cartridge cylinder 11. Other known retention members may also be utilized to retain the cartridge in place depending upon the cartridge design. On/off valve actuator 16*a* which is shown projecting from the cartridge cylinder in FIG. 2 is retained by retention member 17. A disk-shaped flanged member 18 is connected to retention member 17 at the delivery end of chamber 11, the flanged member having a central cut-out aperture 19 adapted to surround cartridge valve actuator 16*a*. The cutout area of disk 18 is adapted to retain cartridges of several types whether or not a valve 16 is mounted on the delivery end. A disposable mixing nozzle 20 is connected to the delivery end of the cartridge valve by a threaded connection and retention nut 21 to connect the disposable mixing nozzle to valve 16. Thus, a positive connection is maintained between the cartridge and delivery nozzle as known in the prior art. The cartridge has a diameter and length adapted to be fitted within the cartridge chamber so that it essentially fills the chamber in snugly seated relation. The cartridge retaining chamber may consist of a rigid, tubular member having a diameter and length closely matching the cartridge or an apertured mesh-type basket or other shape for such positive retention. The chamber may have a split flanged member at its terminus end for grasping the cartridge at or near its discharge end. Such elements can be widely varied.

Body member 12 of the gun has a slightly enlarged right cylindrical second chamber 25 projecting from its opposite end in axial alignment with the first cylindrical chamber 11 for retaining the cartridge. Chamber 25 is positively connected to the body member containing an elongated hollow piston member 26 which is forcibly movable toward the cartridge by a contained pressurized gas such as compressed air or carbon dioxide. The enlarged left hand end of the elongated piston 26 comprises the piston head 27 which is sealingly engaged with the inner wall of chamber 25 by a sealing O-ring 28. An annular groove 28*a* is formed in piston head 27 to seat and retain the O-ring 28. Piston head 27 has quick-release valve 29 mounted with its connector 30 projecting interiorly of the hollow piston head 27 to introduce pressurized gas into the quick-release valve 29.

The opposite end 32 of the piston is contoured to be complementally shaped to the opposite filling end of the cartridge from its delivery end. The cartridge has a contoured movable cap with a depressed central region surrounded by an integral annular ring-type portion which is common to multiple component cartridge caps. The inner or rearward piston head 27 is connected to the outer or forward piston head 32 adapted to contact the cartridge by tie rod 33 which is threadably connected to both ends of the elongated hollow piston. The tie rod 33 extends between the opposing spaced-apart ends of the hollow piston in an axial position, the piston end members being preferably molded of plastic materials.

The quick-release valve 29 is mounted within one portion of the piston head 27 with its connector 30 projecting interiorly of the hollow piston. Pressurized gas is delivered to the quick-release valve by a flexible tubular member 34 such as a flexible plastic tube or hose extending around the exterior of the hollow piston. Such hose member 34 is loose or spirally wrapped around the piston exterior from a source of pressurized gas to the quick-release valve. The gas hose 34 is connected to the source of pressurized gas preferably extending into the handle. The gas hose has a relatively small diameter and is collapsible around one piston during its movement from left-to-right as shown in FIG. 2. The completely interior mounting of the gas hose protects it from abuse and wear due to abrasion. The coiled gas line having a small diameter provides smoother loading of gas pressure on the piston and cartridge.

The handle may or may not contain a second gas valve 35 which may or may not be operable by a trigger 40 mounted within the handle to control delivery of pressurized gas to the pressure chamber 36 within the second hollow chamber 25 and air piston 27. A second connector 37 having a quick-release type fitting is mounted at a lower extremity of the handle 13 for connection to a source of pressurized gas. A second tubular member 50, such as an air hose, extends within the handle from connector 37 to air valve 35 to deliver pressurized gas to the handle area and to the pressurizable chamber 36. The handle 13 is also provided with a trigger guard 38 to protect the trigger 40 from accidental or unintended operation. The gas hose may also project exteriorly through the support handle and connect directly to a quick-release gas coupling which is connectable to the source of pressurized gas. In this alternate co-struction, second gas valve 35 and trigger 40 may be eliminated for gas pressure to be applied directly to quick-release valve 29. The flow of materials from the cartridge or package is controlled by valve 16 with the gas-pressure being maintained on the piston during on-off operation of valve 16.

The tie-rod 33 having threaded receiving openings at its ends is utilized to join the two ends of rigid tubular member 41 of the hollow piston 26 by threaded members connecting the two ends to the tie-rod with threaded metal bolts designated as 41*a* and 41*b*. Thus the hollow piston which comprises a hollow tube 41 can be formed of essentially an enlarged air piston head 27 at its left end and a second smaller head 32 at its other end having a configuration complemental to the cap portion of the filled cartridge. The smaller end has a contour including a central disc portion 42 and a surrounding annular ring portion 43 complementally contoured to the cartridge cap end for delivery of the materials from a two-component cartridge. The piston head 32 is replaceable to substitute various modified types of cartridge-contacting surfaces depending upon the type of cartridge being employed. This portion of the piston head 27 can be readily removed from the piston through chamber 11 for the replacement.

The tubular flexible hose 34 for pressurized air extends from second valve 35 mounted within the handle to the quick-release valve 29 in the piston head 27. The hose is spirally wrapped around the hollow piston for its collapse upon itself as the piston penetrates the cartridge for pressurized material delivery.

Figure 4:
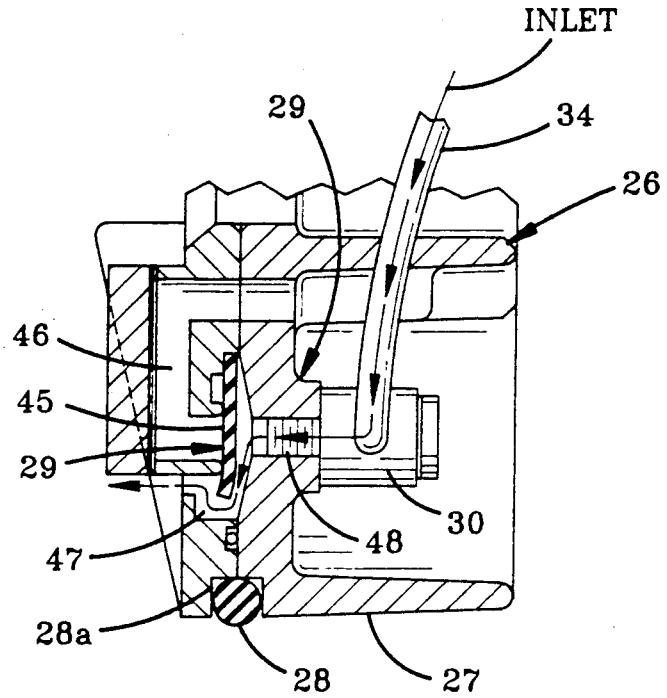
FIG. 4 is an enlarged fragmentary sectional view of a portion of the piston head shown in dotted outline in FIG. 2 showing one operative position of the quick-release valve of the gun piston shown FIG. 2 for its positive movement.
Figure 4A:
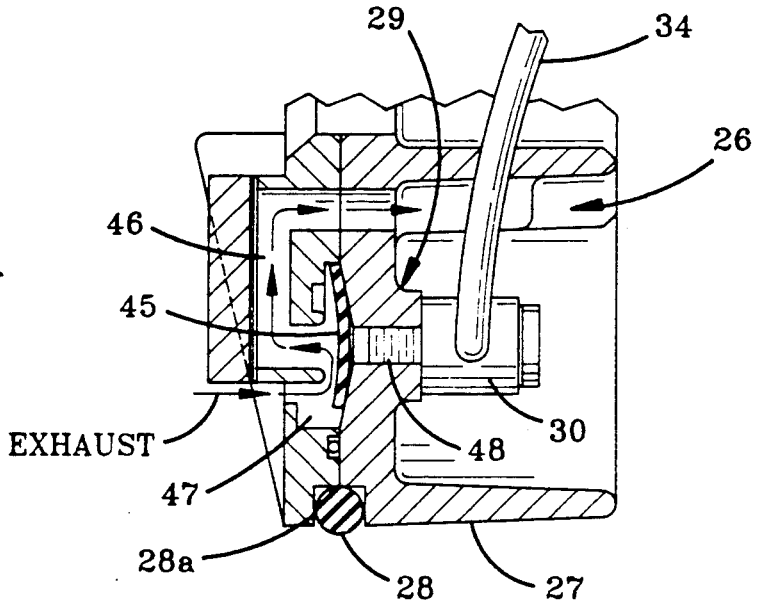
FIG. 4A is an enlarged fragmentary sectional view similar to FIG. 4 showing the quick-release valve in its discharge position with the discharged compressed fluid exiting into the hollow piston of FIG. 2.

The quick-release valve 29 mounted in a localized lower region of piston head 27 may be comprised of one of various types of conventional quick-release valves. As shown in FIG. 4 when pressurized air or other gas is introduced into the quick-release valve through connector 30, an internal flexible diaphragm 45 comprised of a disk of elastomeric material is moved from right-to-left to close the outlet port 46 of piston head 27. Such outlet 46 extends from the diaphragm 45 through piston head 27 opening interiorly of the hollow piston. When the pressurized air is so introduced the air flows around the periphery of the diaphragm 45 through multiple channels 47 into pressurizable chamber 36 to move the piston head from left-to-right as shown in FIG. 2. Such operation is effected by depression of trigger 40 or connection to a pressurized gas source to operate air inlet valve 35 through air hose 34 and the quick-release valve 29. Upon release of the trigger 40, quick-release valve 29 is again operated to move the flexible diaphragm 45 from the position shown in FIG. 4 to that shown in FIG. 4A. The diaphragm 45 is then moved from left-to-right to seal the inlet port 48 of the valve. At that time the pressurized gas within chamber 36 is permitted to exhaust through outlet port 46 through the hollow piston and into the interior of the gun body. The pressurized gas is released very rapidly into the hollow gun body without excessive noise associated with conventional gun operation. Thus, when movement of the piston is stopped by release of the triggers or disconnection of pressurized gas, the pressurized air is exhausted into the gun interior through the quick-release valve. The exhaust air is muffled by its interior release within the hollow gun to provide quiet and vibration-free operation. Any airborne particles such as solids or droplets or oil contained in the released gas are retained within the gut body. Such gas exits through outlet passages 51 in the piston tubular body portion and into the body member and handle of the gun. The muffling is self-contained without any additional components being provided to achieve this function.

As shown in FIG. 3 an indicator rod 51 is attached to the larger piston head 27 in rigid relation extending through chamber 25 parallel to the piston. Its projecting end passes through an aperture in body member 12 and forwardly exteriorly thereof, the rod having a length preferably extending to the cap area of the cartridge. The indicator rod has marked indicia thereon such as a volumetric scale to provide a readable measure of volume delivery of material from the cartridge. Indicia on the rod may extend for essentially the full length of the indicator rod to deliver both small and large volumes of the cartridge material.

Figure 5:
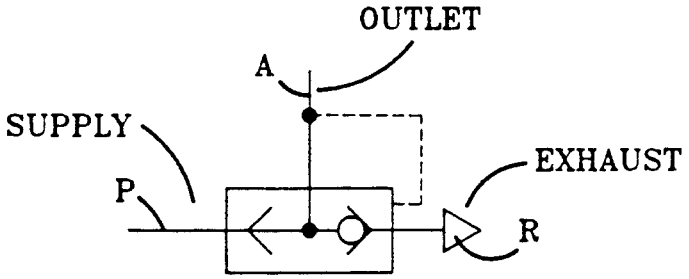
FIG. 5 is a schematic view of the quick-release valve of the gun.

Upon quick release of the pressurized air, pressure on the cartridge is immediately released so that no overflow of the cartridge is effected. Thus, positive control of the delivered material is maintained so that no dribbling or overrun from the cartridge is permitted to occur. Small shots of the material such as from one to a small number of cubic centimeters of the material are ejected through and from the static mixer nozzle 20. The gun is quietly operated, operation is essentially vibration-free and extremely quiet for long term use of the gun without deleterious effects upon the operator or surrounding location. FIG. 5 illustrates the flow of pressurized air to and from quick-release valve 29. The letter P indicates the supply of air to chamber 36 through inlet channel 47. The letter A indicates the flow of air from chamber 36 through outlet channel 46, and the letter R indicates its exhaust position with a check valve i.e. the diaphragm, permitting quick release of air.

A disposable mixer eliminates the need for solvent purging as required in many prior art apparatus. It is an important feature of the subject gun that plural component liquids are metered and/or mixed adjacent to the dispensing location for increased accuracy which is particularly important when dispensing small volumes of material. An important feature of the gun is its self-contained components and quiet operation enabling it to be easily handled by a human operator or to be conveniently integrated into automation or robotic systems. The subject self-contained self-muffled gun of the present invention has a simplified structure which provides an effective, safe, inexpensive and efficient delivery apparatus which eliminates difficulties encountered with prior dispensing apparatus.

In the foregoing description, certain terms have been used for brevity, clearness and understanding but no unnecessary limitations are to be implied therefrom beyond the requirements of the prior art because such terms are used for descriptive purposes and are to be broadly construed.

Moreover, the description and illustration of the invention is by way of example and sets forth a best mode for practicing the invention the scope of the invention being not limited to the exact details shown or described.

Having now described the features, discoveries and principles of the invention the manner in which the improved self-contained self-muffled dispensing gun is constructive and used the characteristics of the construction, and the advantages will in useful results obtained and a new and useful structures, devices, elements, arrangements, parts and combinations are set forth in the appended claims.

I claim:

1. A self-contained pneumatic gun for dispensing one or more flowable materials in precise amount to a point of use comprising:

(a) a body member;

(b) a first hollow chamber attached to said body member for retaining a package containing one or more flowable materials to be delivered at one end therefrom in precise amount to a point of use;

(c) retention means for retaining said package in said first hollow chamber;

(d) a second hollow chamber attached to said body member in axial alignment with said first hollow chamber, said second chamber containing an axially-movable hollow inner piston member adapted to applying compressive pressure to said package at the opposite end of said package from its delivery end;

(e) a quick-release valve means mounted interiorly of said second hollow chamber on an end of said inner piston member oppositely-disposed from said first hollow chamber and said package, said valve means having inlet and outlet ports, the latter permitting rapid exhaust discharge of pressurized gas into the interior of said hollow piston member;

(f) a source of pressurized gas connected to said valve means through a flexible collapsible tubular member for applying compressive gas force to said inner piston member and therethrough, compressive force to said package; and (g) operating means connected to source of gas and said flexible tubular member to deliver pressurized gas to said valve means for axial movement of said inner piston.

2. A self-contained pneumatic gun in accordance with claim 1, wherein said quick-release valve means contains a movable member adapted to rapid discharge of said pressurized gas through said outlet port when said operating means is rendered inoperative, said discharge being internally of the unpressurized plenum space of said second hollow chamber and said body member for self-muffling action.

3. A self-contained pneumatic gun in accordance with claim 1, wherein the operative end of said inner piston member contacting said package has a complemental contour to the contacted portion of said package for material delivery from said package.

4. A self-contained pneumatic gun in accordance with claim 1, wherein the said flexible tubular member connected between said operating means and said valve means is collapsible within said second hollow chamber to facilitate gas-powered movement of said piston member for the length of said package.

5. A self-contained pneumatic gun in accordance with claim 1, wherein the said valve means is mounted on the rearward end of said inner hollow piston to permit gas pressurization of said second hollow chamber behind said inner piston member for its pressurized movement, said valve means permitting discharge of said pressurized gas into an internal space within said body member when pressure is relieved for self-muffling operation.

6. A self-contained pneumatic gun in accordance with claim 1, wherein the said operating means includes a second valve means and an operative trigger member mounted within a supporting handle member attached to said body member.

7. A self-contained pneumatic gun in accordance with claim 1, wherein the said retention means for retaining said package in said first hollow chamber comprises a rigid supportive member for said package with its delivery end projecting exteriorly.

8. A self-contained pneumatic gun in accordance with claim 1, wherein said body member is centrally mounted between said axially-aligned first and second hollow chambers and is complementally shaped having said operating means attached thereto.

9. A self-contained gun in accordance with claim 1 wherein said source of pressurized gas is connected to the said operating means which is mounted on said body member in a supportive handle member.

10. A self-contained pneumatic gun in accordance with claim 1 wherein the said valve means is located in ahead portion of said inner piston member to both axially move said piston and to immediately relieve the operating gas pressure from the working side of said head portion to internally of said hollow portion member to stop said piston movement without overrun by relieving said pressure and to provide self-muffling gas discharge.

11. A self-contained pneumatic gun in accordance with claim 1 wherein the said valve means comprises a quick-release valve mounted integrally on or within a head portion of said piston member, said valve means being disposed remotely from said first hollow chamber.

12. A self-contained pneumatic gun in accordance with claim 1 wherein the said second chamber for said inner piston member contains an indicator rod extending externally of the chamber to indicate length of axial travel of said piston member and the corresponding amount of delivery of the package contents.

13. A self-contained pneumatic gun in accordance with claim 1 wherein the said second hollow chamber containing said inner piston member includes pressure-tight sealing means between the rearward portion of said piston member and the inner wall of said second hollow chamber for pressurized movement of said piston member therewithin.

14. A self-contained pneumatic gun in accordance with claim 1 wherein an operative head portion of said inner piston member is replaceable and has a contoured package-contacting surface complemental to the contacted surface of said package for pressurize delivery of one or more flowable materials therefrom.

15. A self-contained pneumatic gun in accordance with claim 1, the said valve means being mounted integrally with or on the pressurized rearward portion of said hollow piston member and is comprised of moldable materials for quick-release internally of said hollow piston of the pressurized gas.

16. A self-contained pneumatic gun for dispensing one or more flowable materials from a variety of packages in precise amount at a point of use comprising:

(a) a body member;

(b) a first hollow chamber attached to said body member for firm retention of a package containing one or more flowable materials to be delivered therefrom in precise amount to a point of use;

(c) a second hollow chamber attached to said body member in axial alignment with said first hollow chamber, said second hollow chamber containing an axially-movable elongated hollow inner piston adapted to applying compressive gas pressure to said package at its non-delivery end for dispensation of said flowable materials therefrom;

(d) a quick-release valve member mounted interiorly of said second hollow chamber integrally with the head portion of said inner hollow piston member oppositely disposed from said first hollow chamber and said package, said valve member having inlet and outlet ports, the latter being disposed within the interior of said elongated hollow piston member to permit rapid exhaust discharge of the pressurized gas into the interior of said hollow piston member;

(e) a source of pressurized ga connected to said valve member for applying compressive gas force to said head portion of said inner piston member and therethrough compressive force to said package;

(f) a flexible tubular member mounted adjacent said piston member and within said second hollow chamber extending between said valve member and said source of pressurized gas to permit its collapsible movement upon lateral movement of said inner piston member to discharge of the package contents; and (g) operating means connected to said flexible tubular member to deliver pressurized gas to said valve member for controlled axial movement of said inner piston member without overrun by rapid discharge of the pressurized gas from said valve means.

17. A self-contained pneumatic gun in accordance with claim 16 wherein the components of said quick-release valve member are molded from plastic materials and include at least one movable member to permit rapid internal discharge of said pressurized gas.

* * * * *